US007007907B2

(12) United States Patent
Huh

(10) Patent No.: US 7,007,907 B2
(45) Date of Patent: Mar. 7, 2006

(54) ADJUSTABLE KEYBOARD STAND

(76) Inventor: Chul Huh, 6736 Los Verdes Dr. #2, Rancho Palos Verdes, CA (US) 90275

( * ) Notice: Subject to any disclaimer, the term of this patent is extended or adjusted under 35 U.S.C. 154(b) by 174 days.

(21) Appl. No.: 10/405,199

(22) Filed: Apr. 1, 2003

(65) Prior Publication Data

US 2004/0195481 A1 Oct. 7, 2004

(51) Int. Cl.
*E04G 3/00* (2006.01)

(52) U.S. Cl. ..... 248/284.1; 248/279.1; 248/918

(58) Field of Classification Search ..... 248/918, 248/284.1, 279.1, 287.1, 118.3, 118.5, 244, 248/245, 246; 108/108; 339/65, 10, 28, 339/26, 8

See application file for complete search history.

(56) References Cited

U.S. PATENT DOCUMENTS 3,550,891 A * 12/1970 Scott ..... 248/242
4,179,091 A * 12/1979 Bidney ..... 248/265
4,192,424 A * 3/1980 Allsop ..... 211/37
4,387,887 A * 6/1983 Gentry ..... 269/100
4,771,897 A * 9/1988 Ho ..... 211/85.9
5,615,854 A * 4/1997 Nomura et al. ..... 248/287.1
5,692,712 A * 12/1997 Weinschenk et al. ..... 248/118
5,901,933 A * 5/1999 Lin ..... 248/285.1
6,116,557 A * 9/2000 Choy et al. ..... 248/286.1
6,148,739 A * 11/2000 Martin ..... 108/50.01
6,488,248 B1 * 12/2002 Watt et al. ..... 248/279.1
6,547,088 B1 * 4/2003 Wang ..... 211/187
6,591,996 B1 * 7/2003 Wu ..... 211/90.02
6,712,008 B1 * 3/2004 Habenicht et al. ..... 108/96
6,802,089 B1 * 10/2004 Cropelli ..... 4/570

* cited by examiner

*Primary Examiner*—Kimberly Wood
*Assistant Examiner*—Amy J. Sterling
(74) *Attorney, Agent, or Firm*—Knobbe, Martens, Olson & Bear, LLP

(57) ABSTRACT

The present teachings describe an adjustable keyboard stand comprising a keyboard platform, which receives a keyboard instrument, and a mounting assembly which mounts to a piece of furniture, such as a computer table or desk. The mounting assembly includes a mounting component having two sidewalls and a rear wall joined together so as to define a recess that extends in a first direction. The adjustable keyboard stand may further comprise a support member having a first and a second end, wherein the first end of the support member is attached to the keyboard platform, and wherein the second end of the support member is positioned within the recess in the mounting component so as to be slidably and pivotally movable therein. In one aspect, the weight of the support member and the keyboard platform pivots the second end of the support member in a first direction within the recess such that the second end of the support member engages with the rear wall of the recess to maintain the support member at a first vertical location. The vertical location of the support member can be changed by exerting force on the keyboard platform that induces the support member to pivot in a second direction so as to disengage the second end of the support member from the rear wall of the recess to thereby permit free sliding motion of the second end of the support member in the recess.

48 Claims, 4 Drawing Sheets

ADJUSTABLE KEYBOARD STAND

BACKGROUND OF THE INVENTION

1. Field of the Invention

The present invention relates to support assemblies and, in particular, relates to an adjustable keyboard stand.

2. Description of the Related Art

In an office environment, computers are typically used for everyday office tasks, such as word processing. Data entry involves the use of a keyboard to enter information into a computer. Conventional desks or tables are often too high for ergonomic placement of keyboards. Some offices tend to purchase specially designed desks or tables for computers, which can increase overhead costs associated with running a business. Keyboard trays or stands are a desirable low cost alternative. Some keyboard stands are adjustable in height so as to accommodate different users.

Some prior art adjustable keyboard stands are adjustable on discrete components. In one instance, U.S. Pat. No. 5,692,712 illustrates an adjustable keyboard platform attached to a relatively large mounting post having rigid corners with serrated teeth that are discretely positioned along the length of the mounting post. The platform armature locks into the serrated teeth for vertical height adjustment. Unfortunately, this particular prior art mounting post can be inconvenient to operate and difficult to manipulate for level height adjustment. For example, the platform armature can easily become cockeyed during manipulation where one side of the platform armature is positioned on a higher serrated tooth than the other side. This promotes a lopsided keyboard platform and discomfort for the user. Also, vertical height adjustment can be inconvenient in that some users may have a hard time trying to level out the platform during manipulation and lining up of the serrated teeth.

Other prior art keyboard stands have a variety of different attachment mechanisms, such screws and bolts, which often have to be manipulated in order to adjust the stand to a desired vertical height above the ground and also to adjust the tilt angle of the keyboard for the preferences of an individual user. Often times, these fasteners may become difficult to manipulate which makes the adjustment process more cumbersome. U.S. Pat. No. 5,211,367 illustrates this cumbersome task of keyboard platform adjustment. As illustrated, the platform armature has many joints with each having a plurality of locking members that have to be disengaged from underneath the table prior to adjusting the height or orientation of the keyboard tray. Unfortunately, this particular adjustable keyboard tray is inconvenient to use or operate because a user has to crawl underneath the table disengage the locking members, then sit back down while holding the keyboard tray so as to adjust it to the appropriate height or orientation, and then crawl back underneath the table to re-engage the locking members while holding the keyboard tray in the appropriate position. As a result, this adjustable keyboard tray is inconvenient to operate or use for most people.

Therefore, from the foregoing, there currently exists a need for an improved keyboard stand that is readily adjustable and convenient to operate. To this end, there also currently exists a need for a more convenient height adjustment mechanism for a keyboard platform that is easily manipulated by users.

SUMMARY OF THE INVENTION

The aforementioned needs may be satisfied by an adjustable keyboard device comprising a keyboard platform which receives a keyboard and a mounting assembly which mounts to a piece of furniture, the mounting assembly including a mounting component having two sidewalls and a rear wall that defines a recess that extends in a first direction having a vertical component wherein the mounting component defines an opening positioned between the sidewalls opposite the rear wall that extends in the first direction.

In one embodiment, the adjustable keyboard device may further comprise a support member having a first and a second end, wherein the first end of the support member is attached to the keyboard platform, and wherein the second end of the support member is positioned within the recess in the mounting component so as to be slidably and pivotally movable therein. In one aspect, the weight of the support member and the keyboard platform pivots the second end of the support member in a first direction within the recess such that the second end of the support member engages with the rear wall of the recess to maintain the support member at a first vertical location, and wherein the vertical location of the support member can be changed by exerting force on the keyboard platform that induces the support member to pivot in a second direction so as to disengage the second end of the support member from the rear wall of the recess to thereby permit free sliding motion of the second end of the support member in the recess.

In another embodiment, the sidewalls of the mounting component further comprise a pair of channels, and wherein the support member includes a plurality of protrusions that are spaced from the second end such that the protrusions are positioned within the channels so as to define a pivot axis of the support member with respect to the recess. The adjustable keyboard device may further comprise a tilt adjustment assembly that permits adjustment of a tilt angle of the keyboard platform, wherein the tilt adjustment assembly comprises a shaft and a spring that are interposedly attached between the keyboard platform and the support member so as to define the tilt angle. In one aspect, the tilt adjustment assembly further comprises a knob that is threadably attached to the shaft, and wherein the knob can be actuated to increase or decrease the tilt angle of the keyboard platform. In another aspect, the spring produces a biased tension between the keyboard platform and the support member, and wherein the tension can be increased or decreased depending on the position of the knob with respect to the shaft.

The aforementioned needs may also be satisfied by an adjustable stand comprising a mounting bracket attached to a structure and a securing member having an upper section that is rotatably attached to the mounting bracket so as to allow the securing member to rotate with respect to the structure, the securing member having first and second sidewalls and a rear wall that are joined together so as to form an opening with an interior recessed region, wherein the first and second sidewalls each comprise an interior surface having at least one channel formed thereon. In one embodiment, the adjustable stand may comprise a platform having an upper surface adapted to receive a keyboard instrument and a lower surface. In addition, the adjustable stand may comprise a support armature having a first end adapted to be pivotally mounted on the lower surface of the platform and a second end having a plurality of protrusions extending therefrom and stop member attached thereto, wherein the second end is adapted to be positioned within the interior recessed region of the securing member adjacent the interior surface of the sidewalls so that the plurality of protrusions pivotally and slidably communicate with the channels to thereby allow the support armature to pivot about the protrusions and vertically move along the length of the channels, and wherein the stop member inhibits vertical movement of the support armature when engaged with the rear wall of the securing member, and wherein the stop member allows vertical movement of the support armature when disengaged from the rear wall of the securing member. These and other objects and advantages of the present invention will become more fully apparent from the following description taken in conjunction with the accompanying drawings.

DETAILED DESCRIPTION OF THE PREFERRED EMBODIMENTS

Reference will now be made to the drawings wherein like numerals refer to like parts throughout. An improved keyboard stand that is readily adjustable by a user will be described in greater detail herein below with reference to the drawings.

Figure 1:
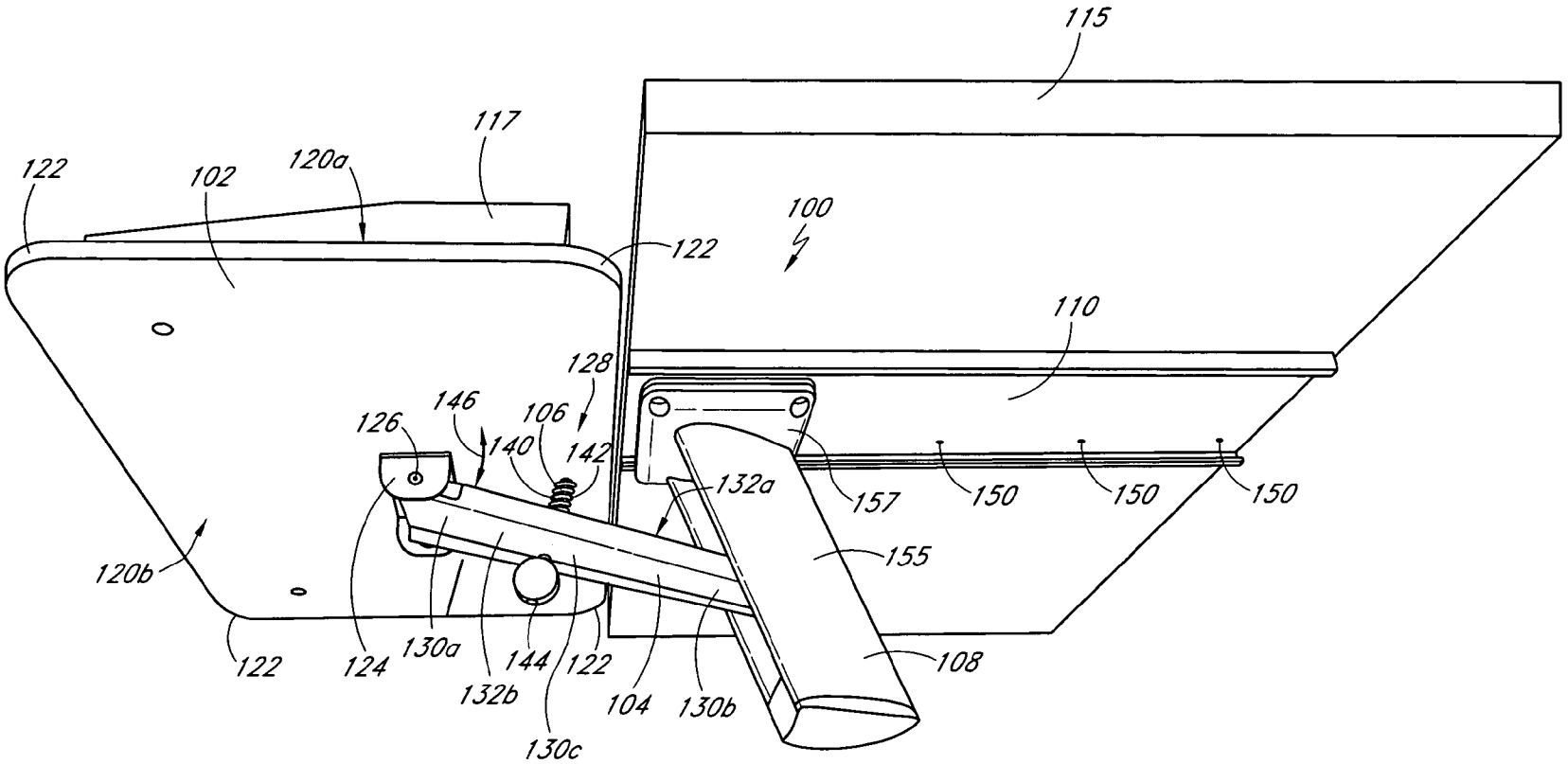
FIG. 1 illustrates one embodiment of an adjustable keyboard stand.

FIG. 1 illustrates one embodiment of an adjustable keyboard stand 100 having a platform member 102, a support member 104, a tilt member 106, a securing member 108 with a main body 155 and an upper head structure 157, and a mounting member 110. As illustrated in FIG. 1, the adjustable keyboard stand 100 is adapted to be fixedly attached to the underside of the piece of furniture 115, such as a table or desk, which will be described in greater detail herein below. Also, the platform member 102 including the support member 104 are continuously adjustable along the length of the securing member in a manner as will be described in greater detail herein below.

In one embodiment, the platform member 102 comprises a substantially rectangular shape with flat upper and lower surfaces 120*a*, 120*b*. The lower surface 120*b* of the platform member 102 is pivotally attached to the support member 104 via a u-shaped bracket 124 and one or more bolts 126. The u-shaped bracket 124 is securely attached to the lower surface 120*b* of the platform member 102 using fasteners (not shown), such as screws, in a generally known manner. In addition, the u-shaped bracket 124 is pivotally attached to a first end 130*a* of the support member 104 using one or more bolts 126 that function as a pivot juncture such that the platform member 102 readily rotates about the one or more bolts 126 with respect to the support member 104.

It should be appreciated that the platform member 102 can be adapted to receive a keyboard or keyboard instrument 117, such as those used with various types of computers, musical instruments, etc. In one aspect, the platform member 102 comprises a strong rigid material, such as wood, plastic, metal, etc., so as to provide a firm platform surface that can support the weight of the keyboard or keyboard instrument 117.

In one embodiment, as illustrated in FIG. 1, the tilt member 106 comprises a shaft 140 and a spring 142 that are interconnected between a rear portion 128 of the platform member 102 and a mid-portion 130*c* of the support member 104. The shaft 140 is positioned central to the spring 142 such that the spring 142, in one aspect, winds around the exterior of the shaft 140. In addition, the shaft 140 is adapted to be connected to the platform member 102 in a generally known manner such that the spring 142 abuts the lower surface 120*b* of the platform member 102. Also, the shaft 140 extends through the support member 104 such that the spring 142 abuts an upper surface 132*a* of the support member 104. In one aspect, the tilt member 106 is spring biased so as to provide tension between the rear portion 128 of the platform member 102 and the mid-portion 130*c* of the support member 104.

As further illustrated in FIG. 1, the tilt member 106 further comprises a knob 144 that is threadably attached to the post 140 such that the knob 144 can be screwed upward or downward along the shaft so as to abut a lower surface 132*b* of the support member 104 and to adjust the tilt angle 146 of the platform member 102 against the tension of the spring 142. The spring produces a biased tension between the platform member 102 and the support member 104, wherein the tension can be increased or decreased depending on the position of the knob 144 with respect to the shaft 140. The tilt member 106 provides adjustment to a tilt angle 146 of the platform member 102. In one aspect, the tilt angle 146 is defined between the platform member 102 and the support member 104 with the vertex of the tilt angle 146 defined at the pivot juncture between the platform member 102 and the support member 104. Advantageously, the tilt angle 146 of the platform member 102 can be adjusted in relation to the support member 104 by readily twisting the knob 128.

In one embodiment, the support member 104 is adapted to be slidably attached to the securing member 108 in a manner that will be described in greater detail herein below. In addition, the securing member 108 is adapted to be slidably and rotatably attached to the mounting member 110 in a manner that will be described in greater detail herein below. Also, the mounting member 110 is adapted to be fixedly attached to the underside of the piece of furniture 115, such as a table or desk. It should be appreciated that the scope and functionality of the securing member 108 and the mounting member 110 will be described in greater detail herein below with reference to FIG. 2.

Figure 2:
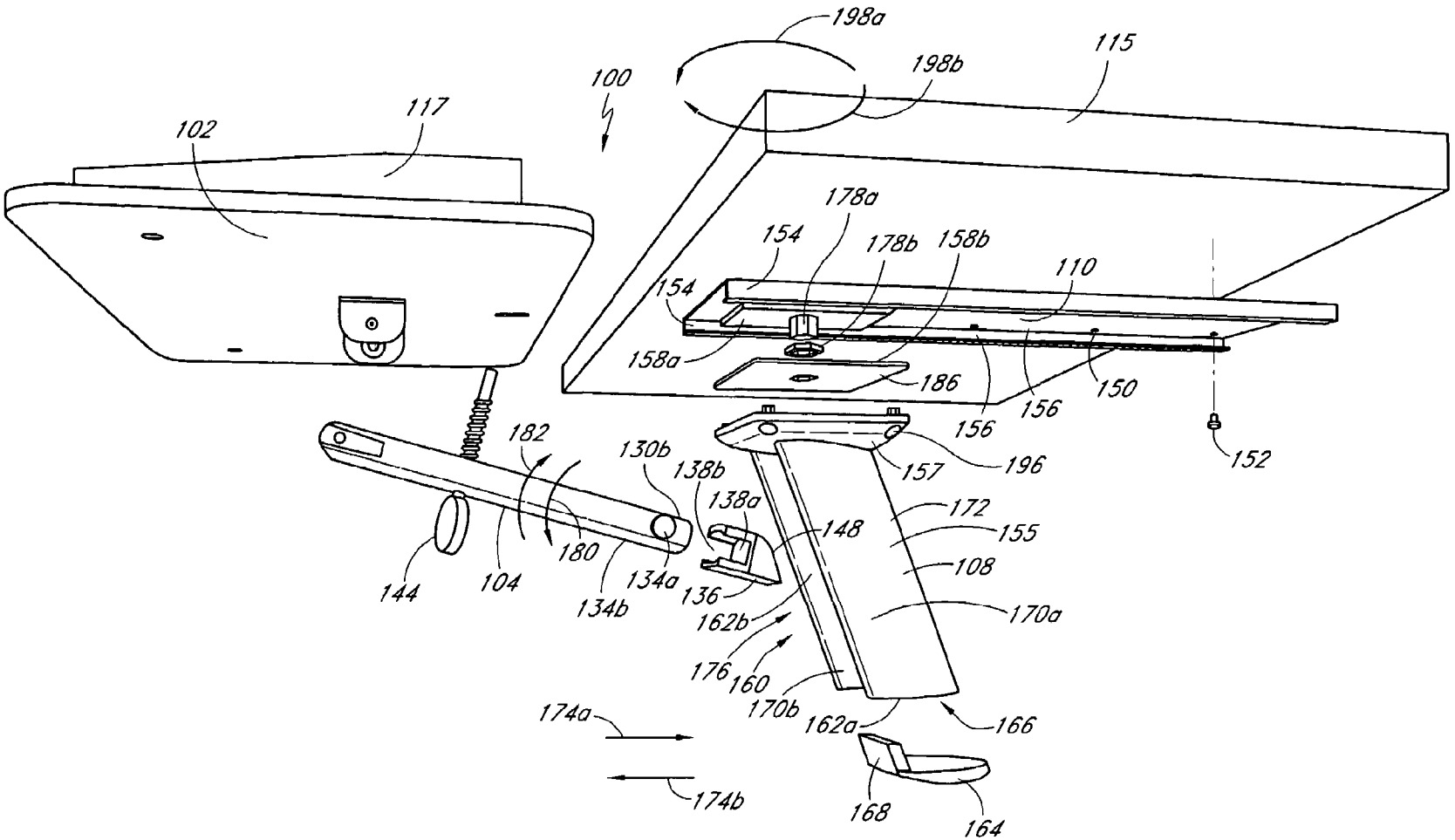
FIG. 2 illustrates an expanded view of the adjustable keyboard stand of FIG. 1.

FIG. 2 illustrates an expanded view of the adjustable keyboard stand 100 of FIG. 1. In one embodiment, the support member 104 comprises first and second protrusions 134*a*, 134*b* that extend outward from a second end 130*b* of the support member 104 in a substantially perpendicular manner so as to define a pivot axis. In one aspect, the pivot axis allows the support member 104 to pivot with respect to the securing member 108 in a manner that will be described in greater detail herein below.

Also, the support member 104 further comprises a stop member 136 that is attached to the second end 130*b* of the support member 104 so as to be adjacent the protrusions 134*a*, 134*b*. The stop member 136 comprises first and second apertures 138*a*, 138*b* that are adapted to receive the first and second protrusions 134*a*, 134*b*, respectively, and allow the stop member 136 to be attached to the second end 130*b* of the support member 104. Also, the stop member 136 still further comprises an inclined end 148 that is adapted to engage with the securing member 108 in a manner as will be described herein below.

It should be appreciated that, even though the stop member 136 is illustrated in FIG. 2 as a separate part, the stop member 136 may be formed as an integral part of the support member 104 without departing from the scope of the present invention. Alternately, it should also be appreciated that the stop member 136 may be formed separately from the support member 104 and comprise a pliable material, such as rubber, having a high frictional coefficient for reasons that will be described in greater detail herein below. In addition, in one aspect, the stop member 136 may be permanently attached to the second end 130*b* of the support member 104 using various types of generally known adhesives, such as epoxy or glue, or fasteners, such as screws or bolts. Moreover, in another aspect, the stop member 136 may be slidably attached to the second end 130*b* of the support member 104 so as to be readily removable therefrom.

Moreover, the securing member 108 comprises first and second sidewalls 170*a,* 170*b* and a rear wall 172 that are joined together in a manner so as to define the main body 155 of the support structure 108 and a recess 160 formed therein that extends in a first direction 174*a*. The securing member 108 further defines first and second interior channels 162*a,* 162*b* within the recess 160 that extend along the length of the securing member 108. The securing member 108 further defines an opening 176 opposite the rear wall 170 that permits access to the recess 160. In one aspect, the second end 130*b* of the support member 104 is positioned within the recess 160 via the opening 176 formed in the securing member 108, as illustrated in FIG. 1, so that the first and second protrusions 134*a,* 134*b* of the support member 104 slidably engage the first and second interior channels 162*a,* 162*b,* respectively.

Advantageously, the support member 104 vertically slides along the length of the securing member 108 via the interior channels so as to provide vertical movement for the platform member 102 with respect to the piece of furniture 115 that the adjustable keyboard stand 100 is mounted thereto. Also, the support member 104 is continuously adjustable along a vertical range of motion with respect to the interior channels 162*a,* 162*b*.

Additionally, the rounded or cylindrical shape of the protrusions 134*a,* 134*b* allow the support member 104 to pivot in a first pivotal direction 180 or in a second pivotal direction 182 that is opposite the first pivotal direction 180. The first and second protrusions 134*a,* 134*b,* when positioned with the first and second interior channels 162*a,* 162*b,* respectively, define the pivot axis. When the support member 104 is positioned within the recess 160 of the securing member 108, the support member 104 can be pivoted about the pivot axis in the first pivotal direction 180 so that the inclined end 148 of the stop member 136 abuts a back wall 172 of the securing member 108. Similarly, the support member 104 can be pivoted about the pivot axis in the second pivotal direction 182 so that the stop member 136 moves away from the back wall 172 of the securing member 108.

In one embodiment, the securing member 108 further comprises a lower end cap structure 164 that is adapted to be positioned in a lower opening 166 of the securing member 108. Advantageously, the lower end cap structure 164 is attached to the securing member 108 so as to retain the second end 130*b* of the support structure 104 in the recess 160 of the securing member 108 to thereby inhibit the support structure 104 from falling away from the securing member 108. Also, the lower end cap structure 164 comprises a lip 168 that extends within at least a portion of the opening 176 formed in the support structure 108.

In one embodiment, the mounting member 110 is adapted to be mounted on the underside of the piece of furniture 115 via fasteners 152, such as screws or bolts, through apertures 150 formed in the mounting member 110. As illustrated in FIG. 2, the mounting member 110 comprises lip structures 154 that define interior slotted regions 156 along the length of the mounting member 110. A first rectangular plate 158*a* having an extension nut 178*a* attached thereto is adapted to be slidably positioned within the slotted regions 156. In one aspect, the first rectangular plate 158*a,* when positioned within the slotted regions 156 of the mounting member 110, is slidable along the length of the mounting member 110 in the first direction 174*a* or a second direction that is opposite the first direction 174*b*. A second rectangular plate 158*b* is attached to the extension nut 178*a* with a fastening washer 178*b* in a generally known manner. The second rectangular plate 158*b* is positioned exterior to the slotted regions 156 of the mounting member 110 so as to provide a mounting surface 186 for the securing member to be mounted thereto.

Additionally, the upper head structure 157 of the securing member 108 is adapted to be mounted to the mounting surface 186 of the second rectangular plate 186 via fasteners 196, such as nuts and bolts. As illustrated in FIG. 2, the positional orientation of the upper head structure 157 is slanted with respect to the main body 155 of the support structure 108. In addition, as illustrated in FIG. 2, the positional orientation of the upper head structure 157 is aligned with the second rectangular plate 186. As illustrated in FIG. 1, the support structure 108 attaches to the mounting member 110 so that the upper head structure 157 is aligned with the mounting member 110 and the main body 155 slants away from the platform member 102. Advantageously, the positional orientation of the main body 155 with respect to upper head structure 157 and the mounting member 110 allows for more leg room for a seated individual using the adjustable keyboard stand 100. For this reason, the present teachings of the adjustable keyboard stand provide greater comfort for a user.

Advantageously, the securing member 108, when attached to the first rectangular plate 158*a* via the second rectangular plate 158*b* and the extension nut 178*a,* slides along the length of the mounting member 110 via the slotted regions 156. This allows the platform member 102, when attached to the mounting member 110 via the support member 104 and the securing member 108, to move towards and away from the piece of furniture 115 in the first and second directions 174*a,* 174*b,* respectively, when the mounting member 110 is attached to the piece of furniture. Moreover, this allows the platform member 102 to comprise more freedom of movement with respect to the piece of furniture.

In one aspect, the extension nut 178*a* is rotatable about the first or second rectangular plates 158*a,* 158*b* so that the securing member 108, when mounted to the mounting member 110, can readily rotate thereabout in a first rotational direction 198*a* or a second rotational direction that is opposite the first rotational direction 198*a*. Advantageously, this allows the platform member 102, when interconnected to the securing member 108 via the support member 104, to comprise more freedom of movement.

Figure 3:
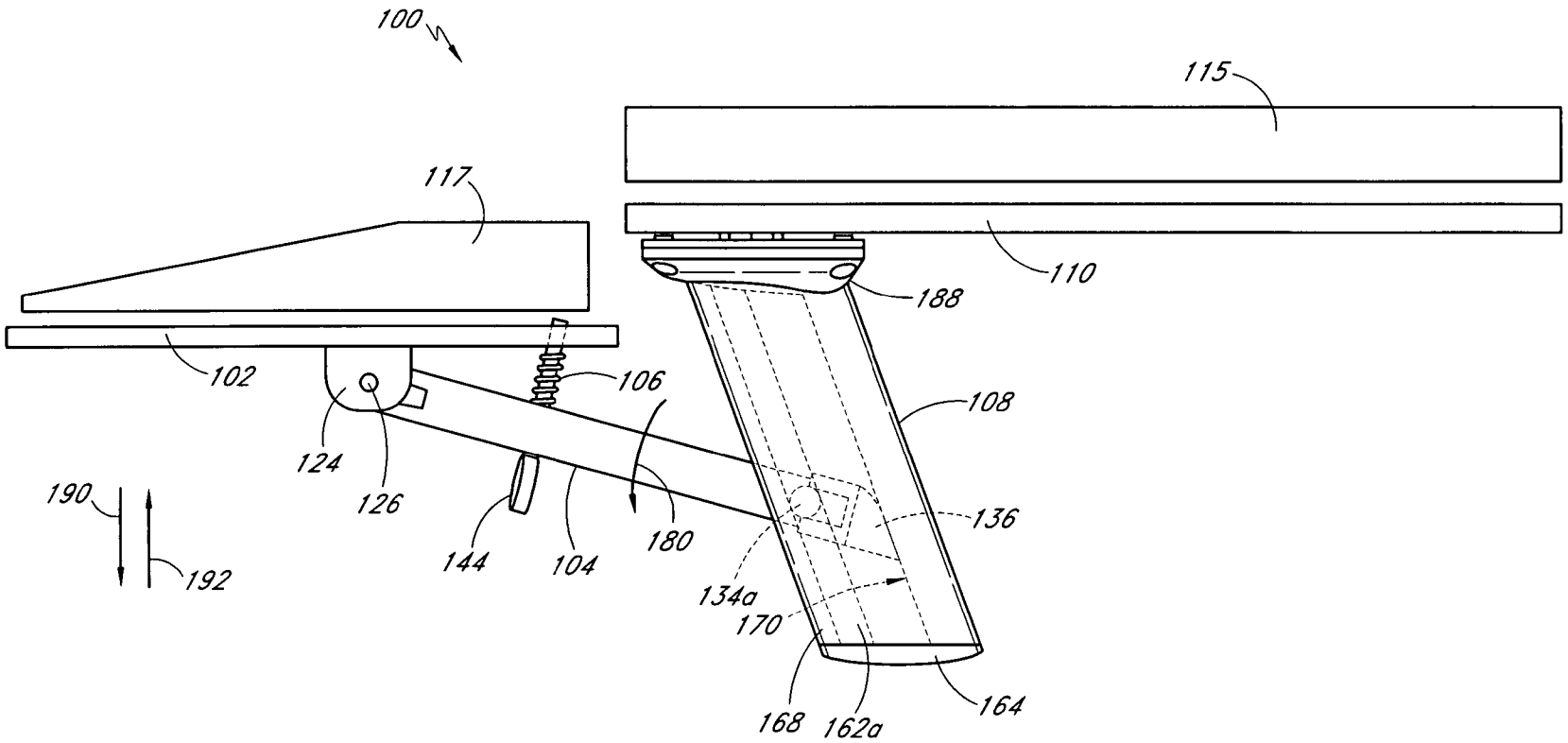
FIGS. 3, 4 illustrate a side view of the adjustable keyboard stand of FIGS. 1, 2.
Figure 4:
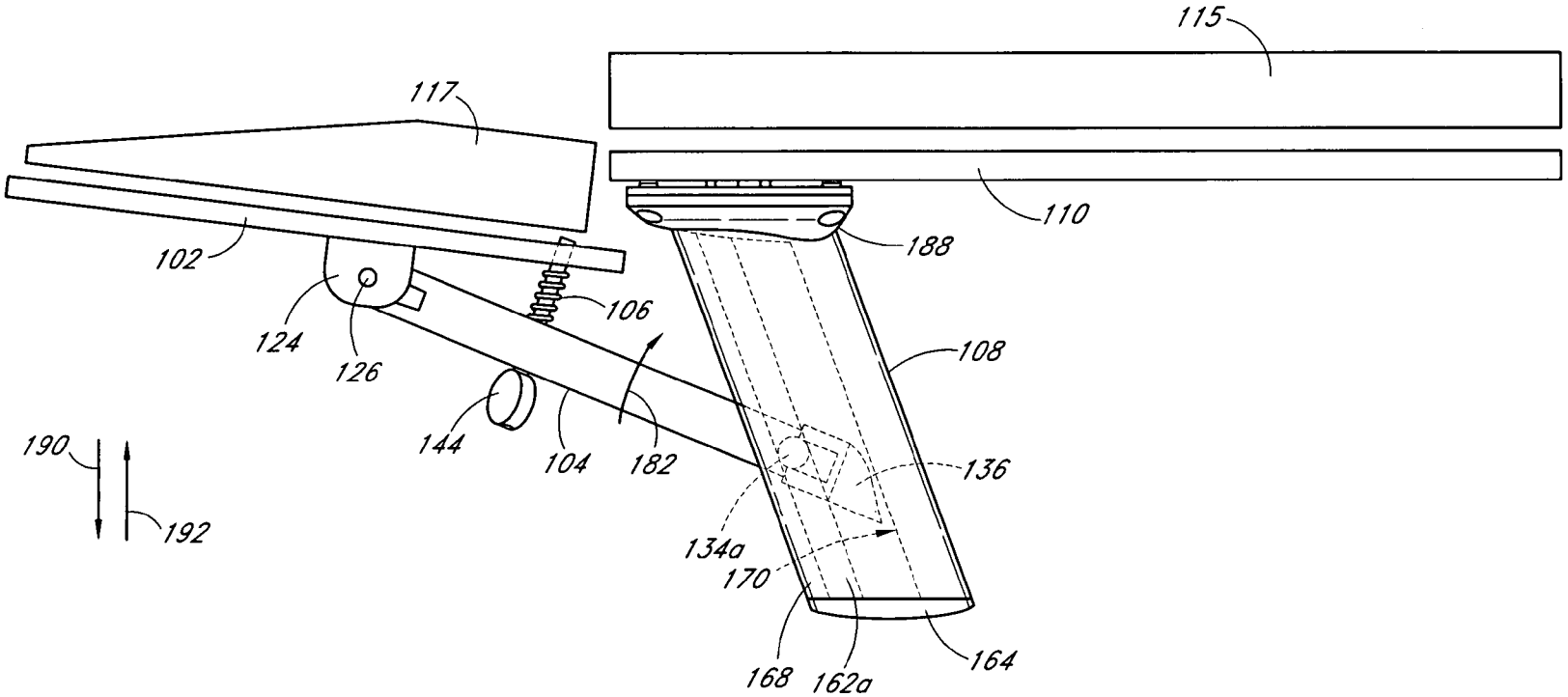

FIGS. 3 and 4 illustrate a side view of the adjustable keyboard stand 100 of FIGS. 1 and 2. In operation, the first and second protrusions 134*a,* 134*b* of the support member 104 are positioned within the first and second channels 162*a,* 162*b* of the securing member 108 so that the support member 104 can be vertically adjusted along the length or vertical component of the securing member 108. In one embodiment, the weight of the platform member 102, including the weight of the keyboard 117 positioned on the platform member 102, induces the stop member 136 to engage with the back wall 172 of the recess 160 formed in the securing member 108.

As illustrated in FIG. 3, the weight of the platform member 102 including, in one aspect, the weight of the keyboard 117 induces the support member 104 to rotate in the first pivotal direction 180 thereby urging the stop member 136 against the back wall 172 of the recess 160 so as to inhibit the platform member 102 from moving in a first vertical direction 190. Advantageously, the stop member 136 comprises a highly frictional material that inhibits slippage of the support member 104 when the stop member 136 abuts the rear wall of the securing member 108.

Conversely, to move the platform member 102 in the first vertical direction 190 or a second vertical direction 192 that is opposite the first vertical direction 190 as illustrated in FIG. 4, a user simply moves the platform member 102 so as to pivot the support member 104 in the second pivotal direction 182 to thereby disengage the stop member 136 from the back wall 172 of the securing member 108. Advantageously, this pivotal actuation enables the platform member 102 to be readily lifted or lowered to one of a plurality of desirable positions along the length of the securing member 104.

Advantageously, the improved keyboard stand 100 is continuously adjustable along a vertical range of motion 190, 192. Readily adjusting the improved keyboard stand 100 to an appropriate height for use results in greater comfort and convenience for an individual using the stand 100 in combination with various keyboard instruments. In addition, the improved keyboard stand 100 of the present teachings can be easily and readily adjusted vertically 190, 192 without the manipulation of a rigid fastener or mounting bracket. Thus, in a manner as previously described and illustrated, the improved adjustable keyboard stand 100 of the present teachings is easier to manipulate than many prior art devices. Furthermore, the improved keyboard stand 100 of the present teachings comprises an adjustable tilt angle 146 for the platform member 102 through the use of the spring biased tilt member 106, which further increases the comfort and convenience for the user.

Although the foregoing description has shown, described and pointed out the fundamental novel features of the invention, it will be understood that various omissions, substitutions, and changes in the form of the detail of the apparatus as illustrated, as well as the uses thereof, may be made by those skilled in the art, without departing from the spirit or scope of the present invention. Consequently, the scope of the invention should not be limited to the foregoing discussion, but should be defined by the appended claims.

What is claimed is:

1. An adjustable keyboard device comprising:

a keyboard platform which receives a keyboard;

a mounting assembly which mounts to a piece of furniture, the mounting assembly including a mounting component having two sidewalls and a rear wall that defines a recess that extends in a first direction having a vertical component wherein the mounting component define an opening positioned between the sidewalls opposite the rear wall that extends in the first direction; and a support member having a first and a second end, wherein the first end of the support member is attached to the keyboard platform, and wherein the second end of the support member is positioned within the recess in the mounting component so as to be slidably and pivotally movable therein, and wherein the weight of the support member and the keyboard platform pivots the second end of the support member in a first direction within the recess such that the second end of the support member engages with the rear wall of the recess to maintain the support member at a first vertical location, and wherein the vertical location of the support member can be changed by exerting force on the keyboard platform that induces the support member to pivot in a second direction so as to disengage the second end of the support member from the rear wall of the recess to thereby permit free sliding motion of the second end of the support member in the recess; and an end cap that is positioned on the mounting component so as to retain the second end of the support member in the recess of the mounting component.

2. The device of claim 1, wherein the sidewalls of the mounting component further includes a pair of channels, and wherein the support member includes a plurality of protrusions that are spaced from the second end such that the protrusions are positioned within the channels so as to define a pivot axis of the support member with respect to the recess.

3. The device of claim 1, wherein the mounting assembly further comprises a pivot assembly that interconnects the mounting component to the piece of furniture, and wherein the pivot assembly permits rotational movement of the mounting component and the support member and the keyboard platform.

4. The device of claim 3, wherein the pivot assembly comprises a mounting bracket that attaches to the piece of furniture and a pivot member that rotatably engages the mounting bracket so as to rotate thereabout.

5. The device of claim 4, wherein the mounting component attaches to the pivot member of the pivot assembly so as to allow the mounting component to rotate about the mounting bracket.

6. The device of claim 5, wherein the mounting bracket comprises slotted regions, and wherein the pivot member slidably engages the slotted regions so as to allow the pivot member to slide along the length of the mounting bracket.

7. The device of claim 1, further comprising a tilt adjustment assembly that permits adjustment of a tilt angle of the keyboard platform.

8. The device of claim 7, wherein the tilt adjustment assembly comprises a shaft and a spring that are interposedly attached between the keyboard platform and the support member so as to define the tilt angle.

9. The device of claim 8, wherein the tilt adjustment assembly further comprises a knob that is threadably attached to the shaft, and wherein the knob can be actuated to increase or decrease the tilt angle of the keyboard platform.

10. The device of claim 9, wherein the spring produces a biased tension between the keyboard platform and the support member, and wherein the tension can be increased or decreased depending on the position of the knob with respect to the shaft.

11. The device of claim 1, wherein the device further comprises a stopper attached to the second end of the support member so as to engage with the rear wall of the recess, and wherein the stopper is formed as an integral part of the support member.

12. The device of claim 1, wherein the device further comprises a stopper slidably attached to the second end of the support member so as to engage with the rear wall of the recess, and wherein the stopper is formed separately from the support member.

13. An adjustable stand comprising:

a mounting bracket attached to a structure;

a securing member having an upper section that is rotatably attached to the mounting bracket so as to allow the securing member to rotate with respect to the structure, the securing member having first and second sidewalls and a rear wall that are joined together so as to form a main body having an opening with an interior recessed region formed therein, wherein the first and second sidewalls each comprise an interior surface having at least one channel formed therein;

a platform having an upper surface adapted to receive a keyboard instrument and a lower surface; and a support armature having a first end adapted to be pivotally mounted on the lower surface of the platform and a second end having a plurality of protrusions extending therefrom and stop member attached thereto, wherein the second end is adapted to be positioned within the interior recessed region of the securing member adjacent the interior surface of the sidewalls so that the plurality of protrusions pivotally and slidably communicate with the channels to thereby allow the support armature to pivot about the protrusions and vertically move along the length of the channels, and wherein the stop member inhibits vertical movement of the support armature when engaged with the rear wall of the securing member, and wherein the stop member allows vertical movement of the support armature when disengaged from the rear wall of the securing member.

14. The adjustable stand of claim 13, wherein the plurality of protrusions are spaced from the second end of the support armature such that the protrusions are positioned within the channels so as to define a pivot axis of the support armature with respect to the securing member.

15. The adjustable stand of claim 13, further comprising an end cap that is positioned on a lower section of the securing member so as to retain the second end of the support armature in the interior recessed region of the securing member.

16. The adjustable stand of claim 13, wherein the mounting bracket comprises slotted regions along the length of the mounting bracket, and wherein the upper section of the securing member slidably engages the slotted regions so as to allow the securing member to slide along the length of the mounting bracket.

17. The adjustable stand of claim 13, further comprising a tilt adjustment assembly that permits adjustment of a tilt angle of the platform.

18. The adjustable stand of claim 17, wherein the tilt adjustment assembly comprises a shaft and a spring that are interposedly attached between the platform and the support armature so as to define the tilt angle.

19. The adjustable stand of claim 18, wherein the tilt adjustment assembly further comprises a knob that is threadably attached to the shaft, and wherein the knob can be actuated to increase or decrease the tilt angle of the platform.

20. The adjustable stand of claim 19, wherein the spring produces a biased tension between the platform and the support armature, and wherein the tension can be increased or decreased depending on the position of the knob with respect to the shaft.

21. The adjustable stand of claim 13, wherein the main body of the securing member is joined to the upper section at a slant.

22. The adjustable stand of claim 13, wherein the structure comprises a piece of furniture.

23. The adjustable stand of claim 13, wherein the stop member is formed as an integral part of the support armature so as to be permanently attached thereto.

24. The adjustable stand of claim 13, wherein the stop member is formed separately from the support armature and is slidably attached to the second end of the support armature so as to be removable therefrom.

25. An adjustable keyboard stand comprising:

a platform having an upper surface that receives a keyboard and a lower surface having a first mounting bracket attached thereto;

a first support having a first end adapted to pivotally mount to the first mounting bracket of the platform and a second end having a plurality of protrusions extending therefrom;

a tilt assembly having a shaft and a spring attached between the platform and the first support so as to define a tilt angle therebetween;

a second support having a plurality of sidewalls joined together so as to define a main body having a recess with a rear wall formed therein, wherein the sidewalls include slotted channels that extend along the length of the main body and are adapted to receive the first and second protrusions of the first support so as to pivotally and slidably communicate therewith when the second end of the first support is positioned within the recess, and wherein the second support includes a head section having an upper mounting surface; and a third support having a first surface that is adapted to receive the upper mounting surface so as to attach thereto and a second surface that is adapted to be attached to a piece of furniture so as to be securely fastened thereto.

26. The adjustable keyboard stand of claim 25, wherein the plurality of protrusions are spaced from the second end of the first support such that the protrusions are positioned within the slotted channels so as to define a pivot axis of the first support with respect to the second support.

27. The adjustable keyboard stand of claim 25, further comprising an end cap that is positioned on a lower section of the second support so as to retain the second end of the first support in the recess of the second support.

28. The adjustable keyboard stand of claim 25, wherein the third support comprises slotted regions along the length of the first surface thereof, and wherein the head section of the second support slidably engages the slotted regions so as to allow the second support to slide along the length of the third support.

29. The adjustable keyboard stand of claim 25, wherein the tilt assembly further comprises a knob that is threadably attached to the shaft, and wherein the knob can be actuated to increase or decrease the tilt angle of the platform.

30. The adjustable keyboard stand of claim 29, wherein the spring produces a biased tension between the platform and the first support, and wherein the tension can be increased or decreased depending on the position of the knob with respect to the shaft.

31. The adjustable keyboard stand of claim 25, wherein the main body of the second support is joined to the head section at a slant.

32. The adjustable keyboard stand of claim 25, wherein the first support member further comprises a stop member formed as an integral part thereof at the second end, and wherein the stop member engages the rear wall of the recess of the second support member when the first support member pivots within the recess so as inhibit vertical movement of the first support member with respect to the second support member.

33. The adjustable keyboard stand of claim 25, wherein the first support member further comprises a stop member slidably attached to the second end of the first support member so as to be removable therefrom, and wherein the stop member engages the rear wall of the recess of the second support member when the first support member pivots within the recess so as inhibit vertical movement of the first support member with respect to the second support member.

34. An adjustable keyboard device comprising:

a keyboard platform adapted to receive a keyboard;

a mounting assembly which mounts to a piece of furniture, the mounting assembly including a securing member having two sidewalls and a rear wall that are joined together to thereby define a recess that extends along a length of the securing member, wherein the securing member further defines an opening positioned between the sidewalls opposite the rear wall that extends along the length of the securing member; and a support member having first and a second ends, wherein the first end of the support member is pivotally attached to the keyboard platform, and wherein the second end of the support member is captured within the recess of the securing member via the opening formed therein so as to be continuously movable along the length of the securing member, wherein the mounting assembly further comprises a pivot assembly that interconnects the securing member to the piece of furniture, and wherein the pivot assembly permits rotational movement of the securing member and the support member and the keyboard platform.

35. The device of claim 34, wherein the second end of the support member is further positioned within the recess of the securing member so as to be pivotally movable therein.

36. The device of claim 35, wherein the weight of the support member and the keyboard platform pivots the second end of the support member in a first direction within the recess of the securing member such that the second end of the support member engages with the rear wall of the recess so as to maintain the support member at a first vertical location.

37. The device of claim 36, wherein the vertical location of the support member can be changed by exerting force on the keyboard platform that induces the support member to pivot in a second direction so as to disengage the second end of the support member from the rear wall of the recess to thereby permit free sliding motion of the second end of the support member in the recess.

38. The device of claim 37, wherein the support member further comprises a stopper attached to the second end thereof, and wherein the stopper engages with the rear wall of the recess when the weight of the support member and the keyboard platform pivots the second end of the support member in the first direction within the recess of the securing member.

39. The device of claim 38, wherein the stopper is formed as an integral part of the second end of the support member.

40. The device of claim 34, wherein the sidewalls of the securing member further include a pair of channels, and wherein the support member includes a plurality of protrusions that are spaced from the second end such that the protrusions are positioned within the channels so as to define a pivot axis of the support member with respect to the recess of the securing member.

41. The device of claim 34, further comprising an end cap that is positioned on the securing member so as to retain the second end of the support member in the recess of the securing member.

42. The device of claim 34, wherein the pivot assembly comprises a mounting bracket that attaches to the piece of furniture and a pivot member that rotatably engages the mounting bracket so as to rotate thereabout.

43. The device of claim 42, wherein the securing member attaches to the pivot member of the pivot assembly so as to allow the securing member to rotate about the mounting bracket.

44. The device of claim 43, wherein the mounting bracket comprises slotted regions, and wherein the pivot member slidably engages the slotted regions so as to allow the pivot member to slide along the length of the mounting bracket.

45. The device of claim 34, further comprising a tilt adjustment assembly that permits adjustment of a tilt angle of the keyboard platform.

46. The device of claim 45, wherein the tilt adjustment assembly comprises a shaft and a spring that are interposedly attached between the keyboard platform and the support member so as to define the tilt angle.

47. The device of claim 46, wherein the tilt adjustment assembly further comprises a knob that is threadably attached to the shaft, and wherein the knob can be actuated to increase or decrease the tilt angle of the keyboard platform.

48. The device of claim 47, wherein the spring produces a biased tension between the keyboard platform and the support member, and wherein the tension can be increased or decreased depending on the position of the knob with respect to the shaft.

* * * * *